US009195182B2

(12) United States Patent
Tanto et al.

(10) Patent No.: US 9,195,182 B2
(45) Date of Patent: Nov. 24, 2015

(54) IMAGE HEATING APPARATUS, LUBRICANT APPLICATION SYSTEM, LUBRICANT APPLICATION METHOD, AND LUBRICANT CONTAINER-APPLICATOR

(71) Applicant: CANON KABUSHIKI KAISHA, Tokyo (JP)

(72) Inventors: Tomoaki Tanto, Toride (JP); Takatoshi Chiba, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/191,720

(22) Filed: Feb. 27, 2014

(65) Prior Publication Data

US 2014/0241769 A1 Aug. 28, 2014

(30) Foreign Application Priority Data

Feb. 27, 2013 (JP) ..... 2013-036758

(51) Int. Cl.
*G03G 15/20* (2006.01)

(52) U.S. Cl.
CPC .... *G03G 15/2025* (2013.01); *G03G 2215/2035* (2013.01)

(58) Field of Classification Search
CPC ..... G03G 15/0275; G03G 15/20
See application file for complete search history.

(56) References Cited

U.S. PATENT DOCUMENTS

| | | | | |
|---|---|---|---|---|
| 7,480,480 | B2 | 1/2009 | Endo et al. | |
| 7,505,725 | B2 | 3/2009 | Katayama et al. | |
| 7,546,078 | B2 | 6/2009 | Okuda et al. | |
| 8,095,058 | B2 | 1/2012 | Chiba | |
| 2012/0201558 | A1 * | 8/2012 | Watanabe | 399/69 |
| 2012/0269562 | A1 * | 10/2012 | Hashimoto | 399/338 |
| 2013/0084102 | A1 * | 4/2013 | Fukuda et al. | 399/122 |
| 2014/0105634 | A1 | 4/2014 | Tanaka et al. | |
| 2014/0241763 | A1 * | 8/2014 | Proffitt et al. | 399/325 |

FOREIGN PATENT DOCUMENTS

JP 10-171276 A 6/1998

* cited by examiner

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

An image heating apparatus to which a lubricant application container is dismountably mountable, the image heating apparatus including: an endless belt configured to heat, in a nip, a toner image on a sheet; a rotatable member cooperative with the belt to form the nip; an urging member extending in a widthwise direction of the belt and configured and positioned to urge the belt toward the rotatable member; and a guide portion configured and positioned to guide a sliding movement of the lubricant application container while substantially preventing dismounting of the lubricant application container during the sliding movement. The lubricant application container applies a lubricant to a sliding surface of the urging member relative to the belt along a longitudinal direction, when the belt is dismounted from the image heating apparatus.

19 Claims, 10 Drawing Sheets

IMAGE HEATING APPARATUS, LUBRICANT APPLICATION SYSTEM, LUBRICANT APPLICATION METHOD, AND LUBRICANT CONTAINER-APPLICATOR

FIELD OF THE INVENTION AND RELATED ART

The present invention relates to an image heating apparatus, a lubricant application system, a lubricant applying method, and a lubricant container-applicator.

There have been known various image forming apparatuses, for example, a printer, a copying machine, a facsimile machine, and a multifunction machine capable of performing two or more functions of the preceding machines and apparatuses. The image formation processes used by these image forming apparatuses are an electrophotographic image formation process, an electrostatic recording process, an electromagnetic recording process, and the like.

These image forming apparatuses, which form an unfixed image on a sheet of recording medium through a process in which an image is formed on an image bearing member, based on the information of the image to be formed, and then, is transferred onto a sheet of recording medium, or a process in which an unfixed image is directly formed on a sheet of recording medium, based on the information of the image to be formed. Further, some of them have been known to be equipped with a fixing apparatus (device), which is an image heating apparatus (device) for fixing an unfixed image (unfixed toner image) on a sheet of recording medium by applying heat and pressure to the sheet of recording medium and the unfixed toner image thereon. Recording media which can be listed as the medium usable by these image forming apparatuses are transfer paper, electro-facsimile paper, electrostatic recording paper, OHP film, printing paper, formatted paper, and the like.

In recent years, from the standpoint of faster startup, energy conservation, etc., fixing devices of the so-called belt heating type have been put to practical use. They employ a fixation belt (endless belt), which is high in thermal conductivity. More concretely, they employ a ceramic heater (pressing member), a pressure roller, and a fixation belt, for example. They are structured so that the fixation belt is sandwiched between the ceramic heater and pressure roller to form a fixation nip. In operation, a sheet of recording medium, on which an unfixed toner image is present, is conveyed through the fixation nip, that is, the interface between the fixation belt and pressure roller, to fix the unfixed toner image to the sheet of recording medium.

Also in recent years, there have been proposed image forming apparatuses equipped with a fixing device, the fixation belt of which is replaceable (Japanese Laid-open Patent Application H10-171276). These fixing devices are structured so that their fixation belt, which is relatively short in service life compared to the other components of the fixing devices, is replaceable. Therefore, the components of the fixing devices, which have not reached the end of their service lives can be used as they are. That is, this structural arrangement for a fixing device made it possible to reduce a fixing device in component cost. Further, from the standpoint of resource conservation, this structural arrangement made it possible to use a fixing device more efficiently than the conventional structural arrangement for a fixing device.

In the case of the fixing devices described above, however, in order to minimize the friction between the fixation belt, and the component on which the fixation belt slides, grease (lubricant) has to be applied to the surface of the component, on which the fixation belt slides, before the fixation belt is attached to the rest of the fixing device during the manufacture of the fixing device, or when the fixation belt is replaced. Thus, it is desired to find a method which can make it easier for a person, who has to replace the fixation belt, to apply grease (lubricant) to the surface of the component, on which the fixation belt slides, in the direction parallel to the lengthwise direction of the component.

SUMMARY OF THE INVENTION

According to an aspect of the present invention, there is provided an image heating apparatus to which a lubricant application container is dismountably mountable, said image heating apparatus comprising an endless belt configured to heat, in a nip, a toner image on a sheet; a rotatable member cooperative with said endless belt to form said nip; an urging member extending in a widthwise direction of said endless belt and configured and positioned to urge said endless belt toward said rotatable member; and a guide portion configured and positioned to guide a sliding movement of the lubricant application container while substantially preventing dismounting of the lubricant application container during the sliding movement, wherein the lubricant application container is effective to apply a lubricant to a sliding surface of said urging member relative to said endless belt along a longitudinal direction, in a state that said endless belt is dismounted from said image heating apparatus.

According to another aspect of the present invention, there is provided a lubricant application system including a lubricant application container and an image heating apparatus to which the lubricant application container is dismountably mountable, said lubricant application system comprising (i) said image heating apparatus comprising (i-i) an endless belt configured to heat, in a nip, a toner image on a sheet, (i-ii) a rotatable member cooperative with said endless belt to form said nip, and (i-iii) an urging member extending in a widthwise direction of said endless belt and configured and positioned to urge said endless belt toward said rotatable member; a guide portion configured and positioned to guide a sliding movement of the lubricant application container while substantially preventing dismounting of the lubricant application container during the sliding movement, wherein the lubricant application container is effective to apply a lubricant to a sliding surface of said urging member relative to said endless belt along a longitudinal direction, in a state that endless belt is dismounted from said image heating apparatus; (ii) said lubricant application container comprising, (ii-i) an accommodating portion configured to accommodate the lubricant, and (ii-ii) an engaging portion engageable with said guide.

According to a further aspect of the present invention, there is provided a lubricant application container for applying a lubricant to an urging member of an image heating apparatus, said image forming apparatus including an endless belt configured to heat, in a nip, a toner image on a sheet, a rotatable member cooperative with said endless belt to form said nip, and an urging member extending in a widthwise direction of said endless belt and configured and positioned to urge said endless belt toward said rotatable member, said lubricant application container comprising an accommodating portion configured to accommodate the lubricant; a discharge opening configured and positioned to permit the lubricant to discharge from said accommodating portion; and an engaging portion engaged with the image heating apparatus and configured to be guided by the image heating apparatus and to substantially prevent dismounting of said lubricant application container from the image heating apparatus when said lubricant application container is slid relative to the image heating apparatus.

According to a further aspect of the present invention, there is provided an endless belt exchanging method for an image heating apparatus, said image heating apparatus including an endless belt configured to heat, in a nip, a toner image on a sheet, a rotatable member cooperative with said endless belt to form said nip, and an urging member extending in a widthwise direction of said endless belt and configured and positioned to urge said endless belt toward said rotatable member, said endless belt exchanging method comprising the steps of dismounting said endless belt from said image heating apparatus; engaging said lubricant application container with said image heating apparatus; applying the lubricant to said urging member while sliding said lubricant application container along a longitudinal direction of said urging member; dismounting said lubricant application container from said image heating apparatus; and mounting a fresh endless belt to said image heating apparatus.

According to a further aspect of the present invention, there is provided a lubricant application container comprising an accommodating portion configured to accommodate the lubricant; a discharge opening configured and positioned to permit the lubricant to discharge from said accommodating portion; and a projected portion provided in at a position more away from said discharge opening than said accommodating portion, said projected portion having a root portion which is thinner than a free end portion.

Further features of the present invention will become apparent from the following description of exemplary embodiments (with reference to the attached drawings).

DESCRIPTION OF THE PREFERRED EMBODIMENTS

Embodiment 1

Hereinafter, embodiments of the present invention are described in detail with reference to the appended drawings. The image heating devices in the following embodiments of the present invention are described as a fixing device for fixing an unfixed toner image to a sheet of recording medium. However, these image heating devices can also be used as a heating device for applying heat and pressure to a fixed image or incompletely fixed image on a sheet of recording medium to alter the image in surface properties.

Figure 9:
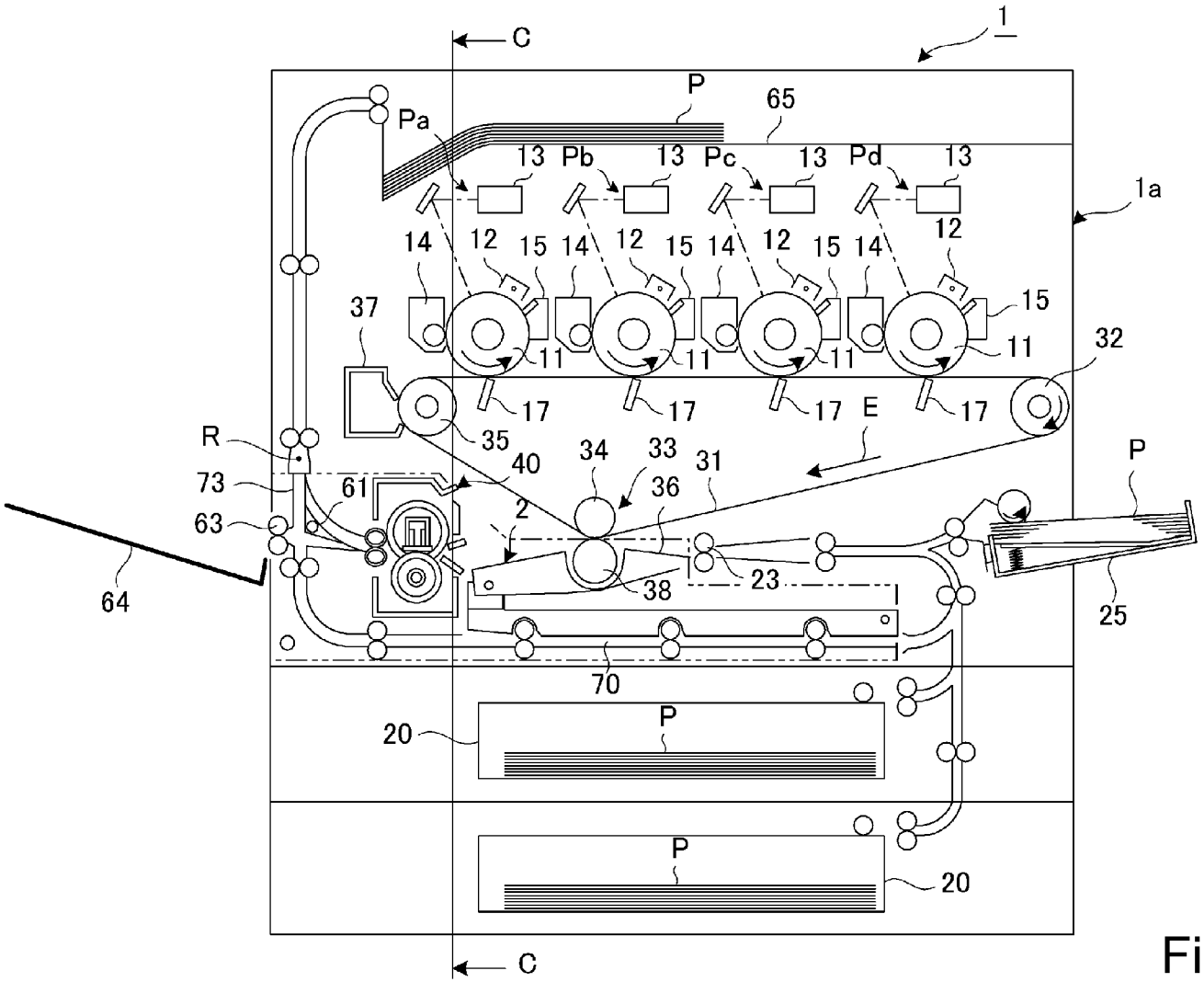
FIG. 9 is a schematic sectional view of a typical image forming apparatus, to the fixing device of which the present invention is applicable. It shows the general structure of the apparatus.

First, referring to FIG. 9, an image forming apparatus 1, which is compatible with the present invention, is described. FIG. 9 is a schematic sectional view of the image forming apparatus 1, equipped with a fixing device 40 which functions as an image heating device, at a vertical plane parallel to the recording medium conveyance direction of the image forming apparatus 1. It shows the general structure of the apparatus 1. This image forming apparatus 1 is a full-color laser printer (electrophotographic color printer) of the so-called tandem type. That is, it has first, second, third, and fourth image formation stations Pa, Pb, Pc and Pd, and an intermediary transfer belt 31 along which the four image formation stations are aligned in parallel.

[Image Forming Apparatus]

Referring to FIG. 9, the first, second, third, and fourth image formation stations Pa, Pb, Pc and Pd of the image forming apparatus 1 are aligned in parallel in the main assembly 1*a* of the image forming apparatus 1. They are the same in structure although they are different in the color of the toner (developer) they use. They form four monochromatic toner images, different in color, one for one. Each image formation station has its own electrophotographic photosensitive member (photosensitive drum 11, in this embodiment), on which it forms a monochromatic toner image.

The image forming apparatus 1 is structured so that the intermediary transfer belt 31 remains in contact with each photosensitive drum 11. In operation, the four toner images, different in color, are formed on the four photosensitive drums 11, one for one, and are transferred (primary transfer) onto the intermediary transfer belt 31, and then, are transferred (secondary transfer) onto a sheet P of recording medium, in the secondary transfer station 33. After the transfer of the toner images onto the sheet P, the sheet P is subjected to heat and pressure by the fixing device 40 so that the toner images are fixed to the sheet P. Then, the sheet P is discharged, as a finished print, from the image forming apparatus 1.

The image formation stations Pa-Pd, and intermediary transfer belt 31, make up an image forming portion, which forms toner images on a sheet P of recording. The fixing device 40 fixes the toner images on a sheet of recording medium to the sheet P, after the formation of the toner images on the sheet P by the image formation portion. As for the examples of recording medium, ordinary paper, resinous paper, cardstock, overhead projector film, and the like can be listed.

There are a charging device 12, a developing device 14, a primary transfer belt 17, and a cleaning device 15 in the adjacencies of each photosensitive drum 11, being arranged in the listed order. There is also disposed a laser scanner 13, which is an exposing means, in the top portion of the image forming apparatus 1.

The laser scanner 13 has an unshown light source, an f-θ lens (unshown), etc. It writes an electrostatic latent image, which is in accordance with the image formation signals, on the charged area of the peripheral surface of the photosensitive drum 11, by scanning (exposing) the peripheral surface of the photosensitive drum 11 with the beam of laser light emitted from the unshown light source; the flux of laser light emitted from the light source is deflected, and focused on the generatrix of the photosensitive drum 11 through the f-θ lens.

The developing devices 14 are filled with a preset amount of Y (yellow), M (magenta), C (cyan) and Bk (black) toners as developers, by unshown toner (developer) supplying devices, one for one. They develop the latent images on the photosensitive drums 11, into visible images, that is, yellow, magenta, cyan and black toner images, respectively.

The intermediary transfer belt 31 is circularly driven at the same velocity as the peripheral velocity of the photosensitive drum 11 in the direction indicated by an arrow mark E in FIG. 9. A toner image of yellow color, or the first color, formed on the photosensitive drum 11 is transferred onto the outward surface of the intermediary transfer belt 31, by the electric field generated by the primary transfer bias applied to the intermediary transfer belt 31, and the pressure, while the toner image is conveyed through the nip between the photosensitive drum 11 and intermediary transfer belt 31.

Similarly, the toner images of the magenta, cyan and black colors, that is, the second, third, and fourth colors, respectively, are sequentially transferred onto the intermediary transfer belt 31 in such a manner that they are layered upon the preceding toner images. Consequently, a synthetic full-color toner image, which reflects the original image, is effected on the intermediary transfer belt 31. Then, the synthetic full-color toner image is transferred onto a sheet P of recording medium in such a manner that preset margins are provided between the transferred full-color image and the four edges of the sheet P, respectively.

After the completion of the primary transfer, the photosensitive drum 11 is cleaned by the cleaning device 15. That is, the toner remaining on the peripheral surface of the photosensitive drum 11 is removed by the cleaning device 15 to prepare the photosensitive drum 11 for the following image formation process. The toner particles, and the like contaminants, remaining on the intermediary transfer belt 31 after the transfer of the synthetic full-color toner image from the intermediary transfer belt 31 are wiped away by an unshown piece of cleaning web (unwoven fabric) placed in contact with the surface of the intermediary transfer belt 31.

A referential numeral 38 stands for the secondary transfer roller, which is supported by a pair of bearings, in parallel to the widthwise direction of the intermediary transfer belt 31, and also, in contact with the downwardly facing portion of the outward surface of the intermediary transfer belt 31. The intermediary transfer belt 31 is suspended and kept stretched by three rollers 32, 34 and 35. The secondary transfer roller 38 is kept pressed against a roller 34, with the placement of the intermediary transfer belt 31 between itself and the roller 34, forming the second transfer nip between itself and intermediary transfer belt 31. To the secondary transfer roller 38, a preset secondary transfer bias is applied by a secondary transfer bias source.

The synthetic full-color toner image on the intermediary transfer belt 31, that is, the combination of four monochromatic toner images, different color, transferred onto the intermediary transfer belt 31, is transferred onto a sheet P of recording medium in the following manner. That is, a sheet P of recording medium is moved out of one of the pair of sheet feeder cassettes 20, or a manual sheet feeder tray 25, and into the main assembly 1*a* of the image forming apparatus 1. Then, the sheet P is sent to a pair of registration rollers 23, which catch the sheet P, and temporarily hold the sheet P. It a case where the sheet P is sent askew, the registration rollers 23 correct the sheet P in attitude.

Then, the registration rollers 23 send the sheet P of recording medium with such a timing that the sheet P enters the secondary transfer nip, following a pre-transfer guide 36, at the same time as the toner image on the intermediary transfer belt 31. At the same time as the sheet P enters the secondary transfer nip, the secondary transfer bias begins to be applied from the secondary transfer bias source. Thus, the synthetic full-color toner image on the intermediary transfer belt 31 is transferred from the intermediary transfer belt 31 onto the sheet P. After the sheet P received the full-color toner image, it is introduced into the fixing device 40 through the pre-fixation guide 2. In the fixing device 40, heat and pressure are applied to the sheet P and the toner image thereon. Consequently, the toner image becomes fixed to the sheet P.

In a case where a toner image is to be formed on only one of the two surfaces of a sheet P of recording medium, a flapper 61 is switched in position. Then, after a toner image is fixed to one of the two surface of the sheet P, the sheet P is discharged into a delivery tray 64, which is attached to one of the lateral walls of the main assembly 1*a* of the image forming apparatus 1, by way of a pair of discharge rollers 63, or a delivery tray 65 which is a part of the top wall of the main assembly 1*a*. Depending on the positioning of the flapper 61, the sheet P is discharged into the delivery tray 64, with its image bearing surface facing upward, or in the delivery tray 65 with its image bearing surface facing downward.

An image forming operation in which a toner image is to be formed on both of the two surfaces of the sheet P of recording medium is as follows. After a toner image is fixed to one of the two surfaces of the sheet P by the fixing device 40, the sheet P is guided upward by the flapper 61, which was switched in attitude. Then, as the trailing edge of the sheet P reaches the reversing point R, the sheet P is reversed in direction, and conveyed into the recording medium conveyance passage 73, being therefore put upside-down. Then, the sheet P is conveyed through a two-sided print passage 70. Then, a toner image is formed on the other (second) surface of the sheet P through an image formation process which is similar to the process in which a toner image was formed on the first surface. Then, the sheet P is discharged into the delivery tray 64 or 65. The portion of the image forming apparatus 1, which is made up of the flapper 61, recording medium conveyance passage 73, and the like structural components, is an example of the means for placing a sheet P of recording medium upside-down.

[Fixing Device]

Next, referring to the drawings, the fixing device 40, which functions as an image heating device, is described in detail about it structure. As described above, the image forming apparatus 1 is equipped with the fixing device 40, which is an image heating device in accordance with the present invention. This fixing device 40 is of the so-called film heating type. It has a fixation film (belt) 101, and a pressure roller 106. The fixation film 101 has a cylindrical thin substrative layer formed of a metallic substance, and an elastic layer formed on the substrative layer. The fixing device 40 is structured so that the pressure roller 106 is driven.

Figure 1:
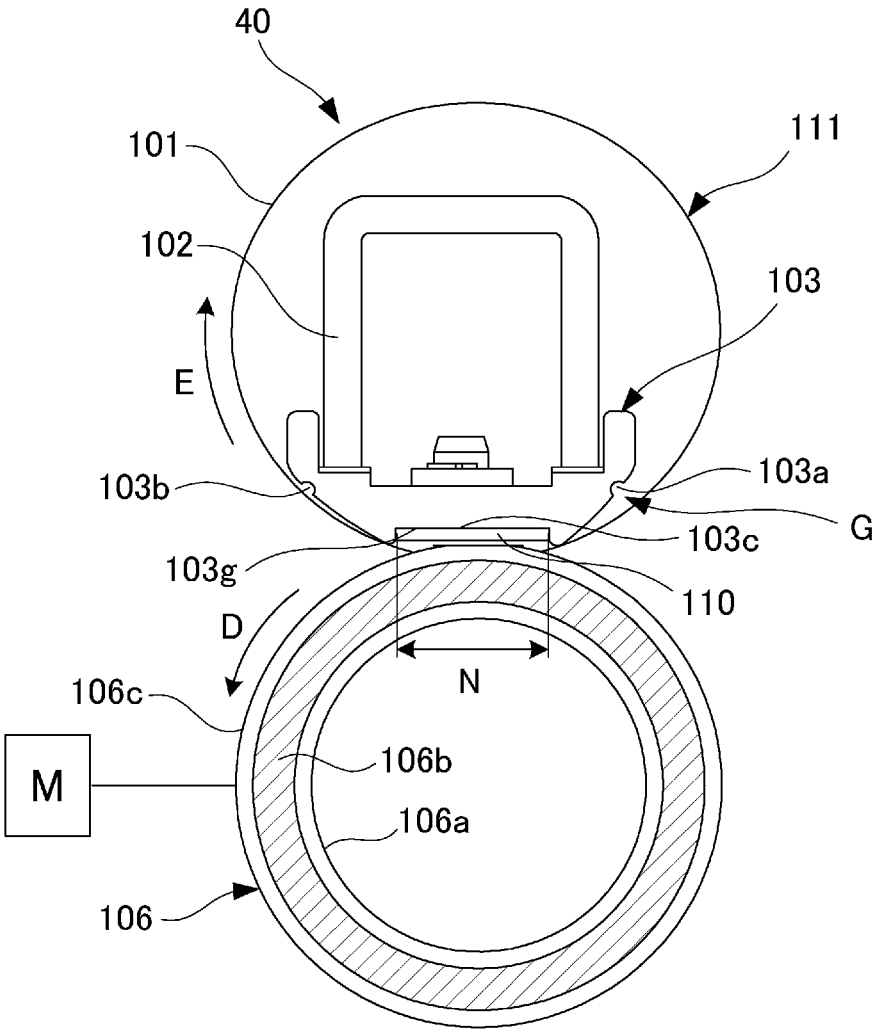
FIG. 1 is a sectional view of the fixing device in the first embodiment of the present invention.
Figure 2:
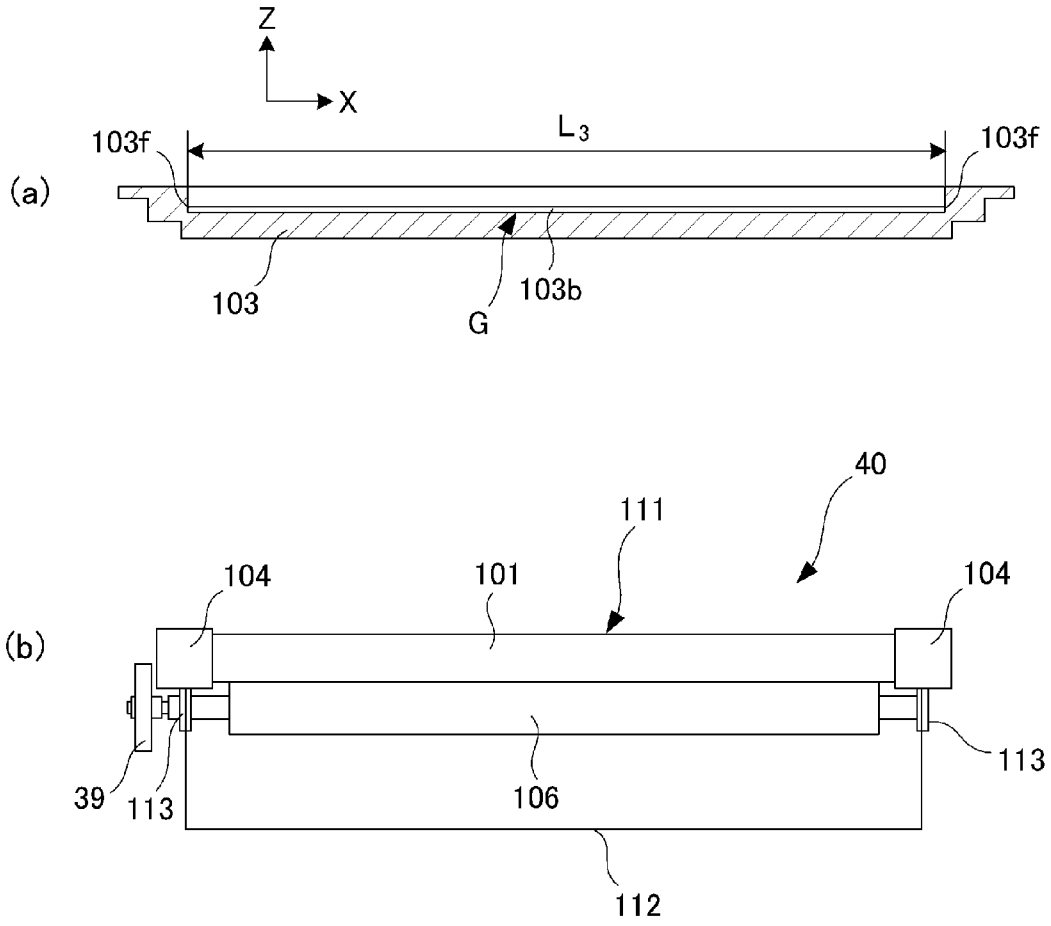
FIG. 2(*a*) is a sectional view of the film guide at a plane A-A in FIG. 4, and FIG. 2(*b*) is a side view of the fixing device.
Figure 3:
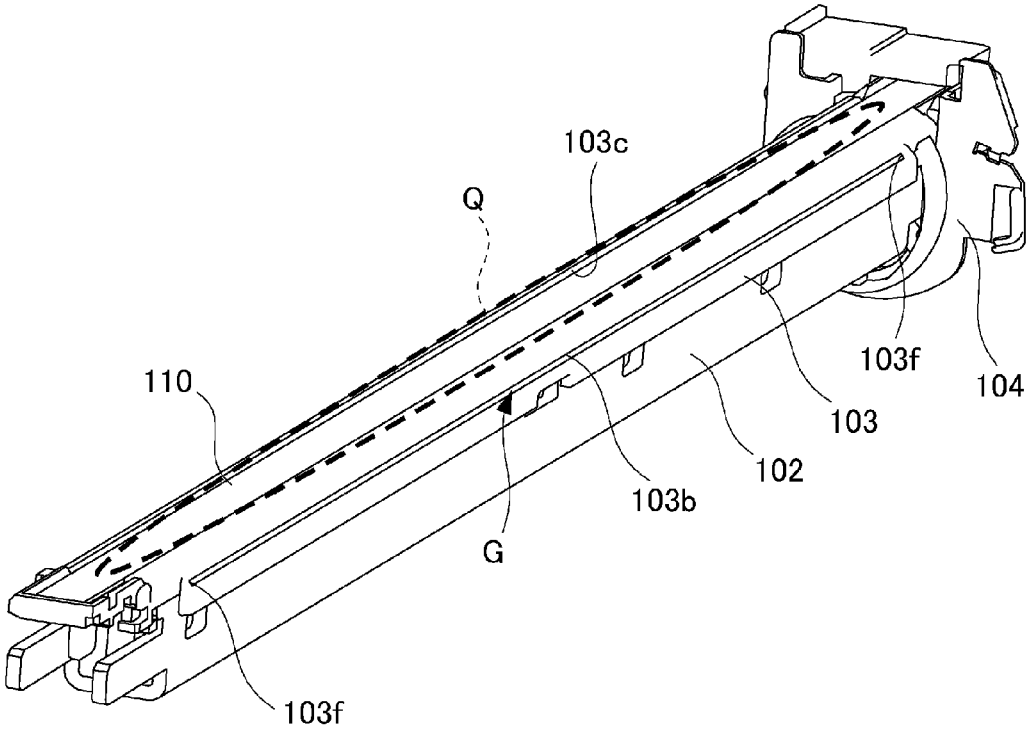
FIG. 3 is a perspective view of the film unit, minus the fixation film and one of the flanges attached to the lengthwise ends of the film unit, one for one. It shows the state of the film unit after the removal of the fixation belt and flange.

First, referring to FIGS. 1, 2(*a*), 2(*b*) and 3, the structure of the fixing device 40 is described. FIG. 1 is a schematic sectional view of the fixing device 40 in this embodiment. It shows the general structure of the fixing device 40. FIG. 2(*a*) is a sectional view of the film guide 103 of fixing device 40, at a plane A-A in FIG. 4(*a*). FIG. 2(*b*) is a side view of the fixing device 40 as seen at a plane C-C in FIG. 9. FIG. 3 is a perspective view of the film unit 111, minus the fixation film 101 and one of the flanges 104 of the film unit 111.

Referring to FIG. 1, the fixing device 40 heats an unfixed toner image on a sheet P of recording medium, with its fixation film 101 (circularly movable endless belt), while the sheet P is moved through the fixation nip N (remaining pinched between fixation film 101 and pressure roller). This fixing device 40 is also provided with an unshown casing in which the fixation film 101, pressure roller 106, etc., are held.

The pressure roller 106 forms the fixation nip N by being pressed upon the fixation film 101. It is a pressure applying rotatable member. The pressure roller 106 circularly moves the fixation film 101 by being placed in contact with the outward surface of the fixation film 101. That is, not only does it form the fixation nip N between itself and fixation film 101, but also, circularly drives the fixation film 101.

Next, referring to FIGS. 1, 2 and 3, the fixing device 40 has: the pressure roller 106, a ceramic heater 110 as a pressing member, the fixation film 101 (endless belt), and the pair of flanges 104. The flanges 104 are positioned at the edges of the film 101, one for one, in terms of the direction parallel to the axial line of the film 101, to regulate the movement of the film 101 in the widthwise direction (indicated by arrow mark X in FIG. 2(*a*)). The ceramic heater (pressing member) 110 is a heating member which is disposed in the hollow of the fixation film 101 to heat the fixation film 101 from within the loop which the film 101 forms.

Further, the fixing device 40 has: the film guide 103 which forms the fixation nip N between itself and the pressure roller 106, with the presence of the fixation film 101 between itself and the pressure roller 106, and circularly moves the fixation film 101; and a stay 102 which is placed on the inward side of the fixation film 101 to reinforce the film guide 101 in terms of stiffness. The ceramic heater 110 extends in the widthwise direction of the fixation film 101 (that is, direction parallel to fixation film 101 as rotational member), and presses the fixing film 101 toward the pressure roller 106. The fixation film 101 is fitted around the combination of the film guide 103 and ceramic heater 110, in such a manner that it is sandwiched between the combination of the film guide 103 and ceramic heater 110, and the pressure roller 106 (rotational driving member). Thus, as the pressure roller 106 is driven, the inward surface of the fixation film 110 slides on the film guide 103 and ceramic heater 110.

The ceramic heater 110 and film guide 103 are in contact with the inward surface of the fixation film 101. The ceramic heater 110 has the function of heating the fixation film 101 from within the inward side of the loop which the cylindrical fixation film 101 forms. It makes the fixation film 101 form the fixation nip N between the fixation film 101 and pressure roller 106. The fixation film 101, ceramic heater 110, film guide 103, stay 102, and flanges 104 make up the film unit 111.

Referring to FIG. 1, the pressure roller 106 is made up of a metallic core 106*a*, and an elastic layer 106*b* concentrically formed around the peripheral surface of the metallic core 106*a*, of heat resistant material such as silicone rubber, fluorinated rubber, fluorinated resin, etc. The pressure roller 106 has also a surface layer as a parting layer 106*c*, which is formed of such a substance as fluorinated resin, silicone resin, fluorosilicone rubber, fluorinated resin, silicone rubber, PFA, PTFE, FEP, etc., that is excellent in parting properties and heat resistance.

Referring to FIG. 2(*b*), the lengthwise ends of the metallic core 106*a* are fitted with a pair of bearings 113, one for one, formed of heat resistant resin such as PEEK, PPS, liquid polymer, or the like. The metallic core 106*a* is rotatably supported by the lateral plates of the fixing device frame 112, with the placement of the pair of bearings 113 between itself and lateral plates, one for one. Further, one of the lengthwise ends of the metallic core 106*a* is fitted with an input gear 39 which receives the rotational driving force from a driving mechanism M.

Referring to FIG. 1, the fixation film (endless belt) 101 is a cylindrical heat resistant film (belt) which is for transferring heat to a sheet P of recording medium. It is loosely fitted around the film guide 103. In order to ensure that the fixing device 40 quickly starts up, the fixation film 101 is required to be small in thermal capacity. Thus, it is formed as single or two-layer film.

In a case where the fixation film 101 is formed as single-layer film, it is desired to be no more than 100 μm, preferably, no more than 50 μm and no less than 20 μm, in thickness. As the material for the single-layer fixation film 101, heat resistance substance such as PTFE, PFA, FEP, and the like can be listed. In a case where the fixation film 101 is formed as two-layer film, the outward surface of cylindrical film formed of polyimide, polyamide-imide, PEEK, PES, PPS, or the like, is coated with PTFE, PFA, FEP, or the like. Further, the fixation film 101 may be formed of a metallic substance, instead of a resinous substance such as those listed above.

The fixation film 101 is rotated by the rotation of the pressure roller 106 which is in contact with the fixation film 101. As the pressure roller 106 is rotated, the fixation film 101 is circularly moved by the rotation of the pressure roller 106, sliding on the heating surface of the film guide 103 fitted with the ceramic heater 110, and remaining in contact with the heating surface of the film guide 103, at roughly the same speed as the speed at which a sheet P of recording medium is conveyed.

As the film guide 103, a heat resistant and thermally insulating component which is roughly semicircular in cross-section, and the length of which is roughly the same as the width of the fixation film 101, may be employed (it is to be positioned in such an attitude that its lengthwise direction becomes perpendicular to the recording medium conveyance direction). As the material for the film guide 103, such a substance as phenol resin, polyimide resin, polyamide resin, polyamide-imide resin, PEEK resin, PES resin, PPS resin, PFA resin, PTFE resin, LCP resin, etc., that is excellent in electrically insulating properties and heat resistance, can be listed. The film guide 103 plays the role of backing up the fixation film 101. It plays also the role of keeping the fixing device 40 stable in the internal pressure of the fixation nip N, which it forms by being pressed against the pressure roller 106, and also, in the circular movement of the fixation film 101 as the fixation film 101 is circularly moved.

The pressure roller 106 is rotationally driven, in contact with the fixation film 101, by the driving mechanism M, which includes a motor, gears, etc., at a preset peripheral velocity, in the same direction as the direction, indicated by an arrow mark D in FIG. 1, in which a sheet P of recording medium is conveyed. As the pressure roller 106 is rotated, the fixation film 101 is given a rotational force which acts in the direction indicated by an arrow mark E in FIG. 1, by the friction which occurs between the pressure roller 106 and fixation film 101 in the fixation nip N as the pressure roller 6 is driven. Thus, the fixation film 101 circularly moves around the film guide 103 in the direction indicated by the arrow mark E, with its inward surface sliding on, and remaining in contact with, the downwardly facing surface of the ceramic heater 110, in the fixation nip N.

As the pressure roller 106 is rotated, the fixation film 101 is rotated by the rotation of the pressure roller 106. As the ceramic heater is supplied with electric power, its temperature rises to a preset target level, and is kept at the target level. Then, a sheet P of recording medium is introduced into the fixation nip N. As the sheet P, on which an unfixed toner image is present, is introduced into the fixation nip N between the fixation film 101 and pressure roller 106, the surface of the sheet P, on which the unfixed toner image is present, comes into contact with the outward surface of the fixation film 101, and the sheet P is moved through the fixation nip N, along with the fixation film 101. While the sheet P is conveyed through the fixation nip N, the heat from the ceramic heater 110 is given to the sheet P through the fixation film 101. Thus, the unfixed toner image on the sheet P becomes fixed to the surface of the sheet P. After being moved through the fixation nip N, the sheet P is separated from the outward surface of the fixation film 101 by the curvature of the fixation film 101 (film guide 103), and then, is conveyed further to be discharged.

Next, referring to FIGS. 1 and 3, the film guide 103 is formed of relatively soft resin. Thus, the stay 102 is placed in contact with the back surface of the film guide 103 to reinforce the film guide 103, more specifically, to prevent the film guide 103 from bending in the direction perpendicular to the lengthwise direction of the film guide 103, and also, to keep the film guide 103 correct in shape and attitude.

Referring to FIGS. 2(*a*) and 3, there are disposed the pair of flanges 104 at the edges of the fixation film 101, one for one. These flanges 104 are fitted around the lengthwise ends, one for one, of the combination of the film guide 103 and stay 102. They guide the fixation film 101 as the fill 101 circularly moves. Further, they prevent the fixation film 101 from disengaging from the combination in the lengthwise direction of the combination.

Referring to FIGS. 1, 2(*a*) and 3, the film guide 103 is provided with a groove 103*c*, the bottom surface 103*g* of which is flat, and in which the ceramic heater (pressing member) 110, which is long and narrow, is to be embedded. The groove 103*c* extends in the lengthwise direction of the film guide 103. The ceramic heater 110 has a ceramic substrate, which is thin, long, and narrow, and a layer of heat generating resistor formed on the surface of the ceramic substrate. The ceramic heater 110 structured as described above is such a heater that is low in thermal capacity, being therefore characterized in that as electric current is flowed through it, it can very quickly increase in temperature. It is supported by the film guide 103, by being embedded in the above described groove 103*c* in the downwardly facing surface of the film guide 103.

Referring to FIGS. 1 and 3, the film guide 103 has a grease application guide G, which guides a grease container-applicator 200 (lubricant container-applicator), while making it virtually impossible for the grease container-applicator 200 to disengage from the film guide 103, in the direction indicated by an arrow mark Z (FIG. 2(*a*)), when grease is applied to the ceramic heater 110 (and part of film guide 103). The grease application guide G has a pair of grooves 103*a* and 103*b* which extend in the lengthwise direction of the film guide 103. The grooves 103*a* and 103*b* guide the grease container-applicator 200 when the surface 110*a* (FIG. 4(*a*)) of the ceramic heater 110, on which the fixation film 101 slides, is coated with grease (lubricant) after the removal of the fixation film 101. The film guide 103 is structured so that the grooves 103*a* and 103*b* extend in the same direction as the surface 110*a* (to be coated with lubricant) of the ceramic heater 110, which is to be coated with the lubricant.

The grooves 103*a* and 103*b* are positioned so that they do not come into contact with the fixation film 101 when the fixing device 40 is in use. They guide the grease container-applicator 200 by the pair of protrusive guides 203*a* and 203*b*, with which the grease container-applicator 200 is provided, in such a manner that the protrusive guides 203*a* and 203*b* slide in the grooves 103*a* and 103*b*, respectively. The grease container-applicator 200 is used to coat the ceramic heater 110 with grease after the removal of the fixation film 101 from the film unit 111.

Figure 4:
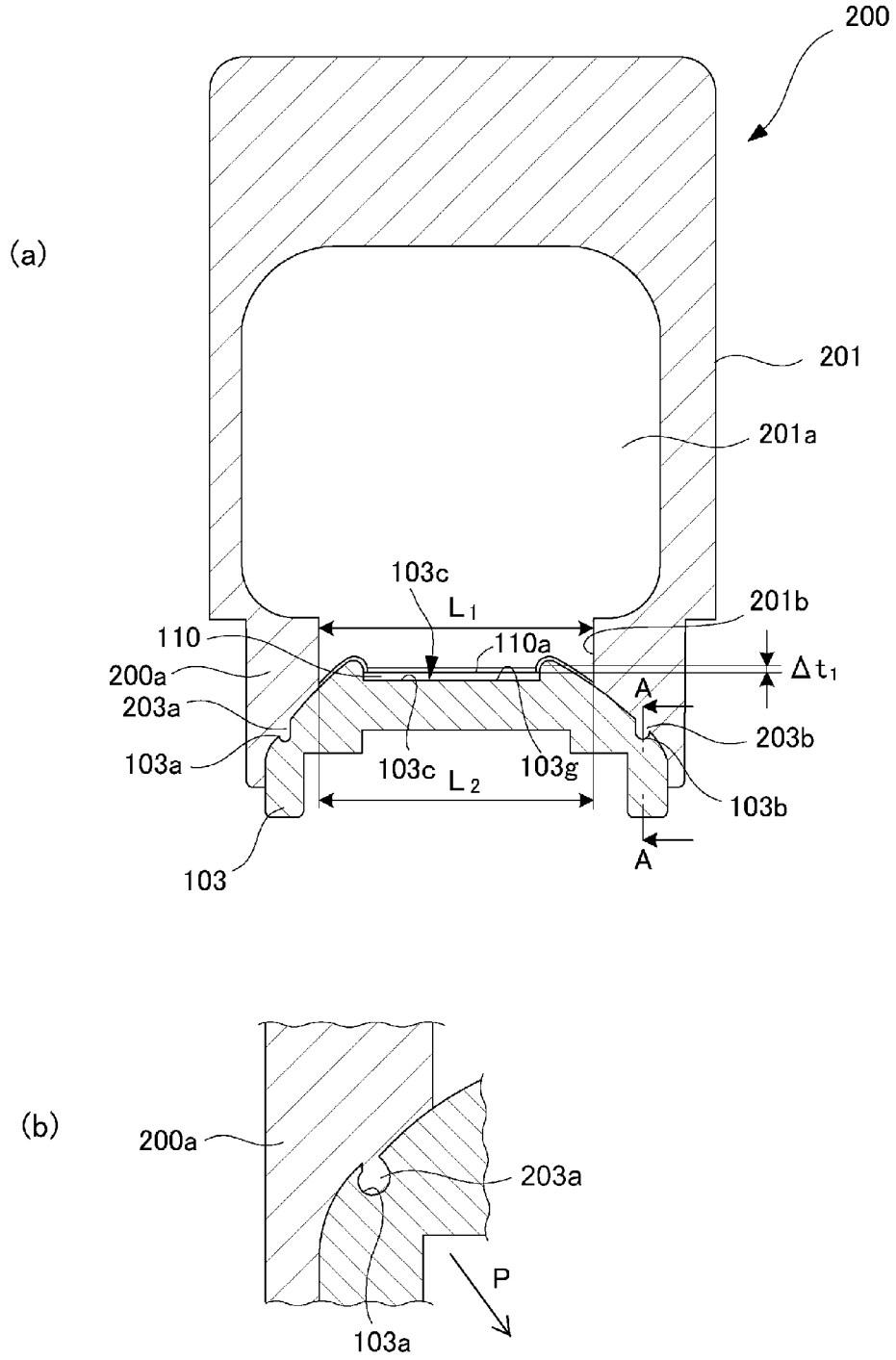
FIG. 4(*a*) is a sectional view of the grease container-applicator, at a plane perpendicular to the lengthwise direction of the ceramic heater and film guide, and FIG. 4(*b*) is an enlarged sectional view of one of the grooves of the film guide, and the corresponding protrusive guide of the grease container-applicator.

FIG. 4(*a*) is a sectional view of the combination of the grease container-applicator 200, ceramic heater 110, and film guide 103, as seen from the direction parallel to the lengthwise direction of the combination, when the ceramic heater 110 is being coated with grease. FIG. 4(*b*) is an enlarged sectional view of the engaged combination of the groove 103*a* (103*b*) and protrusive guides 203*a* (203*b*). As will be evident from these drawings, in terms of the direction (indicated by arrow mark P in FIG. 4(*b*)) in which the protrusive guide 203*a* (203*b*) protrudes from the main portion 200*a* of the grease container-applicator 200, the base portion of the protrusive guide 203*a* (203*b*) is narrower than the center portion of the protrusive guide 203*a* (203*b*). That is, the combination of the grease container-applicator 200 and film guide 103 is structured so that when the grease container-applicator 200 is slid along the film guide 103, it is virtually impossible for the grease container-applicator 200 to disengage from the film guide 103.

FIG. 4(*a*) is drawn as if the grooves 103*a* and 103*b* in this embodiment are simply open upward. In reality, however, the grooves 103*a* and 103*b* are structured as shown in FIG. 4(*b*). That is, they are shaped so that they clamp the base portions of the protrusive guides 203*a* and 203*b*, respectively. The protrusive guides 203*a* and 203*b* of the grease container-applicator 200 are shaped so that at least a part of their middle to end portions are greater in dimension, in terms of their widthwise direction (left-right direction of FIG. 4), than their base portion. The protrusive guides 203*a* and 203*b*, that is, the protruding portions of the main portion 200*a* of the grease container-applicator 200, and the grooves 103*a* and 103*b* of the film guide 103, that is, the recessed portions of the main portion 200*a*, engage with each other in such a manner that the latter embrace the former. That is, in terms of their cross-section, the grooves 103*a* and 103*b* are recessed in such a shape that their contour matches that of the protrusive guides 203*a* and 203*b*, respectively. Therefore, it is virtually impossible for the grease container-applicator 200 to become disengaged upward from the film guide 103 while it is moved for grease application.

Incidentally, the relationship between the groove 103*a* (103*b*) and protrusive guide 203*a* (203*b*) in terms of their shape (recessive or protrusive) may be opposite from the one in this embodiment. That is, the main portion 200*a* of the grease container-applicator 200 may be provided with a pair of grooves 103*a* and 103*b* (grooves), and the film guide 103 may be provided with a corresponding pair of protrusive guides 203*a* and 203*b*. The effects of such structural arrangement are the same as the effects of this embodiment.

The operation for applying grease to the ceramic heater 110 is as follows. Referring to FIG. 3, one of the flanges 104, that is, the removable one (left one in FIG. 3), is to be removed from the film guide 103. Then, the film guide 103 is to be fitted with the grease container-applicator 200 from the left side of the film guide 103 in such a manner that protrusive guides 203*a* and 203*b* fit into the grooves 103*a* and 103*b*, respectively. With the protrusive guides 203*a* and 203*b*, which also are shaped as described, being fitted in the grooves 103*a* and 103*b*, respectively, which also shaped as described above, it is virtually impossible for the grease container-applicator 200 to become disengaged from the film guide 103. Thus, the grease container-applicator 200 can be smoothly guided along the film guide 103 in the lengthwise direction of the film guide 103.

Each of the lengthwise ends of the groove 103*a* (103*b*) is provided with a surface 103*f* which prevents (regulates) the protrusive guides 203*a* (203*b*), that is, the grease container-applicator 200, from moving outward of the film unit 111, beyond the surface 103*f*. That is, as the grease container-applicator 200 is slid along the film guide 103, its protrusive guide 203*a* (203*b*) comes into contact with the regulating surface 103*f*. In other words, the regulating surface 103*f* determines the length (L3 in FIG. 2(*a*)) of the range, in terms of the lengthwise direction of the film guide 103, in which the grease is applied to the ceramic heater 110. That is, because of the presence of the regulating surface 103*f* at the lengthwise ends of the grooves 103*a* (103*b*), only the preset range of the ceramic heater 110 can be coated with grease, in terms of the lengthwise direction of the heater 110. In other words, it is prevented that grease is applied to the portions of the ceramic heater 110, which are on the outward side of the regulating surface 103*f* in terms of the lengthwise direction of the ceramic heater 110.

[Structural Details of Grease Container-Applicator]

Figure 5:
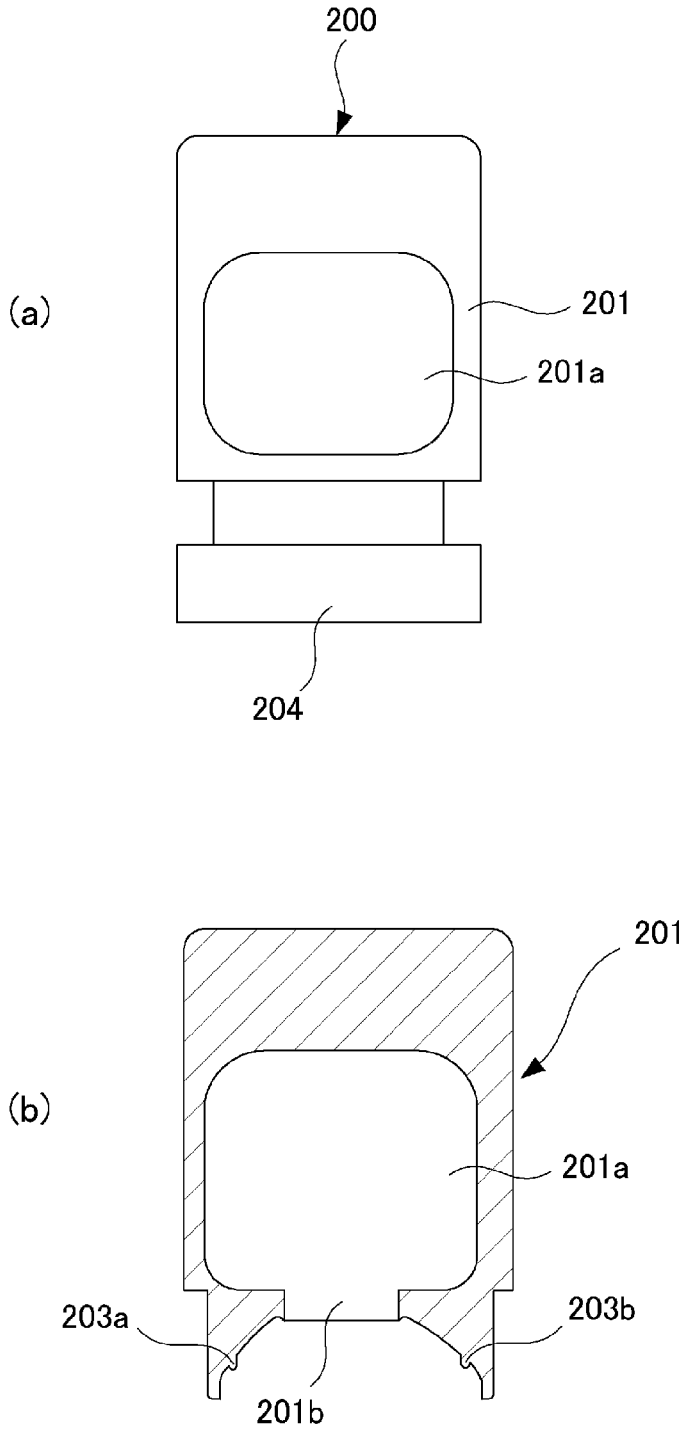
FIG. 5(*a*) is a front view of the grease container-applicator, and FIG. 5(*b*) is an enlarged schematic sectional view of the grease container-applicator, minus the cap of the grease container-applicator.

Next, referring to FIGS. 4(*a*), 4(*b*), 5(*a*) and 5(*b*), the structure of the grease container-applicator 200, which is used during the replacement of the fixation film 101 of the fixing device 40, is described in detail. FIG. 5(*a*) is a front view of the grease container-applicator 200 in this embodiment, and FIG. 5(*b*) is a schematic sectional view of the grease container-applicator 200 after the removal of the cap 204 of the grease container-applicator 200.

The grease container-applicator 200 is a container-applicator for applying grease to the ceramic heater (pressing member) 110 (object to be coated with grease). Referring to FIGS. 4(*a*), 4(*b*), 5(*a*) and 5(*b*), the grease container-applicator 200 has a grease storing member 201, which is roughly in the form of a rectangular parallelepiped, and the pair of protrusive guides 203*a* and 203*b*. As the guides 203*a* and 203*b* are pressed upon the film guide 103, they fit into the grooves 103*a* and 103*b* of the film guide 103, in such a manner that they slide in the grooves 103*a* and 103*b*, respectively. The grease storing member 201 has a grease storage 201*a*.

Further, the grease container-applicator 200 has a grease outlet 201*b*, and the cap 204 with which the grease storage portion 201 is fitted to prevent the grease in the grease storage 201*a* from leaking. This cap 204 is removably attachable to the grease storage (lubricant storage) 201*a* to seal the grease outlet (lubricant outlet) 201*b*.

The removal of the cap 204 from the grease storing member 201 enables the grease outlet 201*b* to discharge outward the grease stored in the storing portion 201*a*. The grease outlet 201*b* is the lubricant outlet which enables the grease in the grease storage member 201 to be applied to the ceramic heater 110 while the protrusive guides 203*a* and 203*b* are slid in the grooves 103*a* and 103*b*.

In this embodiment, the grease storage 201*a* of the grease storing member 201, contains roughly 2 g of grease, in practical terms. The 2 g of grease is the right amount of grease for coating the ceramic heater 110 only once, by moving the grease storing member 201 of the grease container-applicator 200 along the ceramic heater 110 in the direction indicted by an arrow mark T.

As for the material for the grease storing member 201 and cap 204 of the grease container-applicator 200, it is desired to be such a substance as polypropylene, for example, that is excellent in terms of oil resistance and water resistance. As for the grease, heat resistant lubricant (heat resistant grease) made up of perfluoropolyether (as base), polytetrafluoro-ethylene (PTFE as density-increaser), etc., for example, is usable.

Referring to FIGS. 5(*a*) and 5(*b*), as the cap 204 is removed from the grease storing member 201, the protrusive guides 203*a* and 203*b* become exposed, and therefore, it becomes possible for the protrusive guides 203*a* and 203*b* to be pressed into the grooves 103*a* and 103*b*, respectively. The grease container-applicator 200 and film guide 103 are structured so that when the protrusive guides 203*a* and 203*b* are in engagement with the grooves 103*a* and 103*b*, respectively, the width (L1 in FIG. 4) of the grease outlet 201*b* is equal to the width (dimension) (L2 in FIG. 4) of the surface of the film guide 103, which is to be coated with the grease, in terms of the direction perpendicular to the lengthwise direction of the film guide 103.

Referring to FIG. 4(*a*), the gap Δt1 between the grease outlet 201*b*, and the surface 110*a* of the ceramic heater 110, on which the fixation film 101 slides, is set to satisfy the following requirement. In FIG. 4(*a*), M1 stands for the total amount of grease to be applied to the ceramic heater 110 (and part of film guide 103), and S1 stands for the surface area of the ceramic heater 110 (and part of film guide 103). The grease container-applicator 200 and film unit 111 are structured to satisfy the following equation:

$$\Delta t1 = M1/S1.$$

Figure 6:
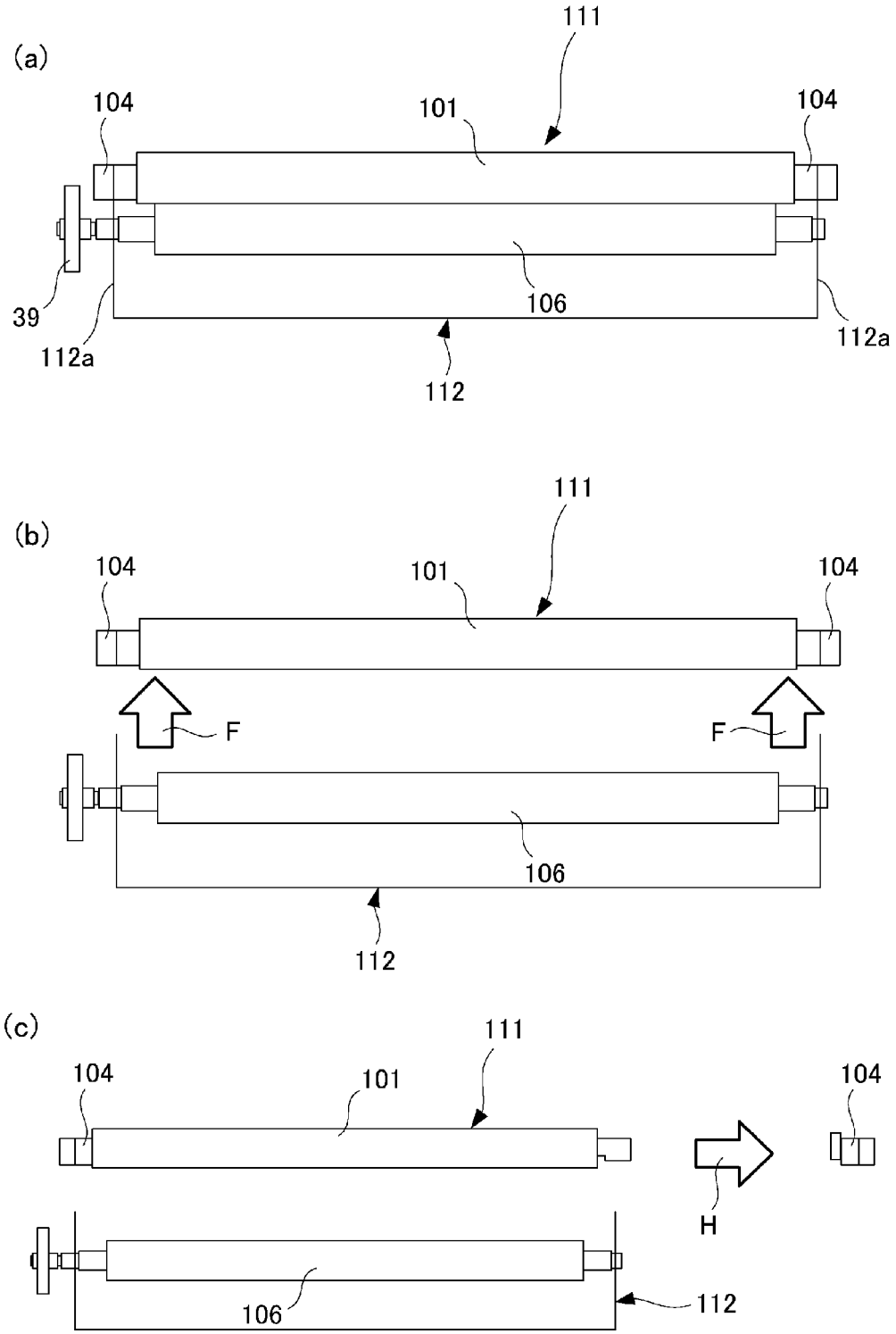
FIGS. 6(*a*)-6(*c*) are side views of the fixing device, which show the fixation film replacement procedure.

Next, referring to FIGS. 3, 6(*a*)-6(*c*), and 7(*a*)-7(*c*), the procedure for replacing the fixation film 101 of the fixing device 40 is described in steps. FIGS. 6(*a*)-6(*c*), and 7(*a*)-7(*c*) are side views of the fixing device 40, which show the steps through which the fixation film 101 of the fixing device 40 is to be replaced. For the sake of convenience, FIGS. 6(*a*)-6(*c*) were dawn to make the flanges 104 appear smaller than those in FIG. 3. However, the flanges 104 in FIGS. 7(*a*)-7(*b*) are the same in function as those in FIGS. 6(*a*)-6(*c*).

The lubricant applying method for applying grease to the ceramic heater (pressing member; object to be coated with grease) 110 of the fixing device 40 in this embodiment roughly comprises the following steps.

First, the fixation film 101 is to be slipped away from the film guide 103 (first step). Then, the protrusive guides 203*a* and 203*b* of the grease container-applicator 200 is to be fitted into the grooves 103*a* and 103*b*, respectively, of the film guide 103, while the grease container-applicator 200 is held in such an attitude that the grease outlet 201*b* faces the film guide 103. Then, the grease container-applicator 200 (grease storing member 201) is to be moved along the film guide 103 (second step) to coat the ceramic heater 110 with the grease. Finally, a replacement (brand-new) fixation film 101 is to be fitted around the combination of the film guide 103 and the ceramic heater coated with a fresh supply of grease (third step).

Next, the above-described method for applying grease to the ceramic heater 110 (and part of film guide 103) is concretely described in further detail.

First, the film unit 111 supported by the fixing device frame 112 is to be lifted away (FIG. 6(*b*)) from the frame 112, by which the film unit 111 and pressure roller 106 are held (FIG. 6(*a*)).

Next, referring to FIG. 6(*c*), the operator is to pull the flange 104 attached to one of the lengthwise ends of the film unit 110, away from the film unit 111 in the direction indicated by an arrow mark H while holding the film unit 111 away from the frame 112.

Figure 7:
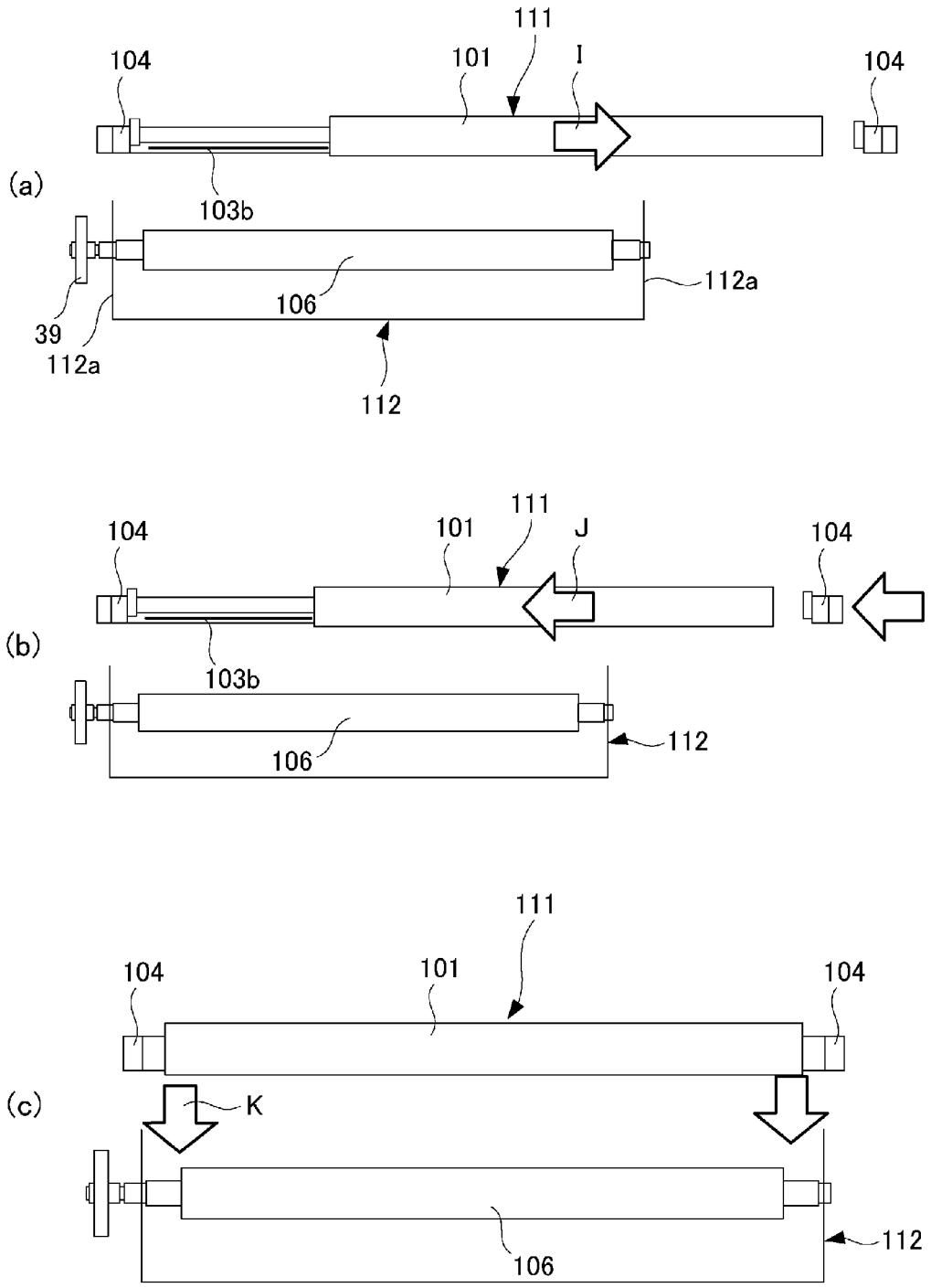
FIGS. 7(*a*)-7(*c*) are side views of the fixing device, which show the fixation film replacement procedure.

Then, referring to FIG. 7(*a*), after the operator removed the flange 104 from one of the lengthwise ends of the film unit 110, the operator is to pull the fixation film 101 away from the film unit 111 in the direction indicated by an arrow mark I. After the removal of the fixation film 101, the fixing device 40 appears as shown in FIG. 3. It sometimes occurs that when the fixing device 40 is in the state shown in FIG. 3, there remains a certain amount of used grease adhering to an area Q (contoured by broken line in FIG. 3), that is, the area of contact between the ceramic heater 110 (and part of film guide 103) and fixation film 101. Thus, in order to clean the area Q, the area Q is to be wiped with alcohol or the like cleaning agent as necessary.

Next, the operator is to apply a fresh supply of grease to the cleaned ceramic heater 110 (and part of film guide 103). After the application of the grease, the operator is to fit the fixation film 101 around the combination of the film guide 103 and ceramic heater 110 in the direction indicated by an arrow mark J, from the side from which the fixation film 101 was removed in FIG. 7(*a*). Next, referring to FIG. 7(*b*), the operator is to attach the flange 104 removed (FIG. 6(*a*)) from one of the lengthwise ends of the film unit 111, to the corresponding end of the film unit 111 in the direction indicated by the arrow mark J.

Lastly, referring to FIG. 7(*c*), the operator is to lower the reassembled film unit 111 (which is in the state shown in FIG. 6(*b*)) to the frame 112, and press the film unit 111 upon the frame 112, to put the film unit 111 back into the state shown in FIG. 6(*a*), ending thereby the operation to replace the film unit 111.

Figure 8:
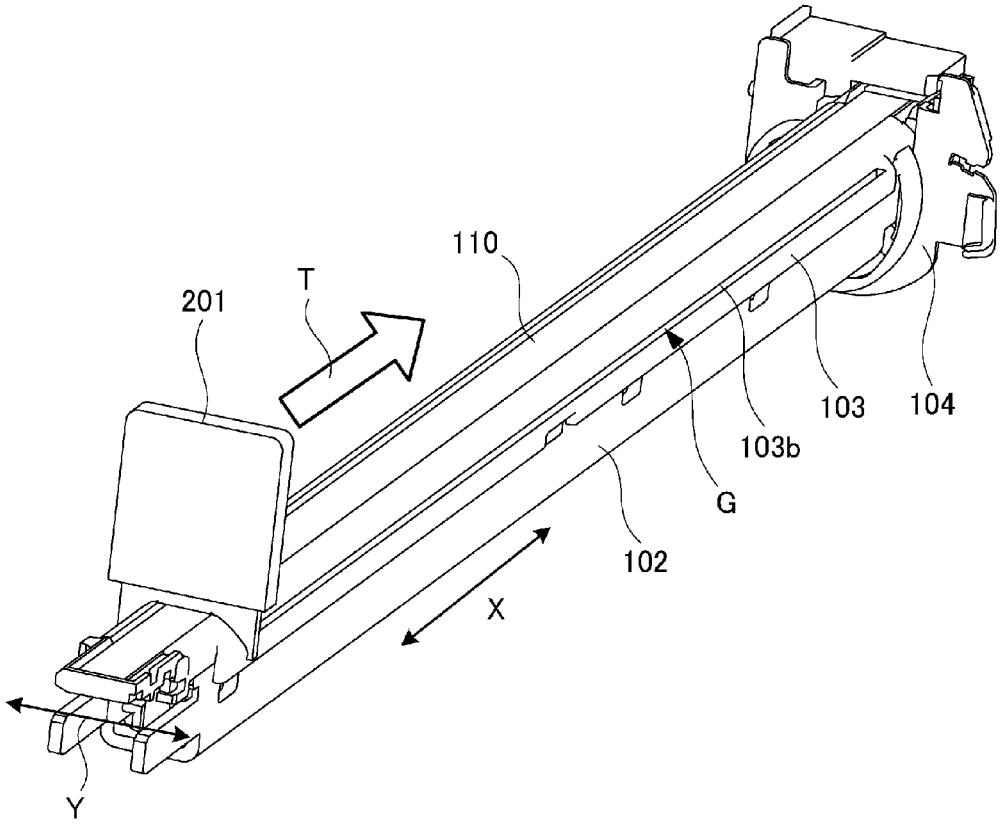
FIG. 8 is a perspective view of the combination of the fixing device (minus fixation film and one of film unit flanges), and grease container-applicator, during the grease application.

At this point in time, referring to FIGS. 4(*a*), 4(*b*), 5(*a*), 5(*b*) and 8, the lubricant applying method for applying grease to the ceramic heater 110 (and part of film guide 103) with the use of the grease container-applicator 200 when the film unit 111 is in the state shown in FIG. 7(*a*) is described. FIG. 8 is a perspective view of the combination of the grease container-applicator 200, film guide 103, and ceramic heater 110, during the grease application.

First, the operator is to remove the cap 204 from the grease container-applicator 200 shown in FIG. 5(*a*), to make the grease container-applicator 200 appear as shown in FIG. 5(*b*). Then, the operator is to align the protrusive guides 203*a* and 203*b* of the grease storing member 201 with the grooves 103*a* and 103*b* of the film guide 103, respectively, and to press the grease storing member 201*a*. As the grease storing member 201 is pressed by the operator in the manner described above, the protrusive guides 203*a* and 203*b* engage into the grooves 103*a* and 103*b*, at the lengthwise end (left end in FIG. 8) of the film unit 111 (film guide 103), from which the flange 104 was removed, as shown in FIG. 8, because both the material for the protrusive guides 203*a* and 203*b* (grease container-applicator 200), and the material for the film guide 103 (grooves 103*a* and 103*b*), are elastic.

As described above, the dimension (L1) of the grease outlet 201*b* is equal to the dimension (L2) of the surface of the film guide 103, which is to be coated with grease, in terms of the widthwise direction of the film guide 103. Therefore, it is possible for the operator to slide the grease storing member 201 in the direction indicated by an arrow mark T, that is, the lengthwise direction (indicated by arrow mark X) of the film guide 103, while continuously discharging the grease in the grease storing member 201 through the grease outlet 201*b*, and also, keeping the grease storing member 201 pressed on the film guide 103. Therefore, it is possible to uniformly apply grease to the ceramic heater 110 (and part of film guide 103), to a preset thickness, while insuring that the grease storing member 201 slides in the direction indicated by the arrow mark X without dislodging from the film guide 103 in the direction indicated by the arrow mark Y, that is, the direction perpendicular to the lengthwise direction of the film guide 103.

Since the film unit 111 and grease container-applicator 200 are designed so that the gap $\Delta t1$ between the grease outlet 201*b* and ceramic heater 110 satisfies: $\Delta t1 = M1/S1$, the grease in the grease storing member 201*a* is used up virtually at the same time as the grease storing member 201 reaches the end of its movement in the direction indicated by the arrow mark T in FIG. 8.

As will be evident from the foregoing description of this embodiment, this embodiment makes it possible for an operator of the image forming apparatus 1 to accurately apply a preset amount of grease to the ceramic heater 110 in the lengthwise direction of the ceramic heater 110 during the replacement of the fixation film 101. That is, this embodiment makes it possible for the operator to extremely efficiently replace the fixation film 101.

In this embodiment, the pressing member embedded in the film guide 103 was the ceramic heater 110. However, this embodiment is not intended to limit the present invention in terms of the pressing member to be embedded in the film guide 103. For example, the pressing member to be embedded in the film guide 103 may be a pressure pad, or the like, which is formed of SUS and does not have a heating function. In such a case, the fixing device has only to be equipped with a separate means for heating the fixation film 101. Also in such a case, the pressure pad (as pressing member) is to press the fixation film 101 toward the pressure roller 106 from within the fixation film loop, to form a nip between the fixation film and pressure roller 106. That is, the present invention is also applicable to a fixing device, the film guide of which holds a pressure pad as a film pressing member.

Embodiment 2

Figure 10:
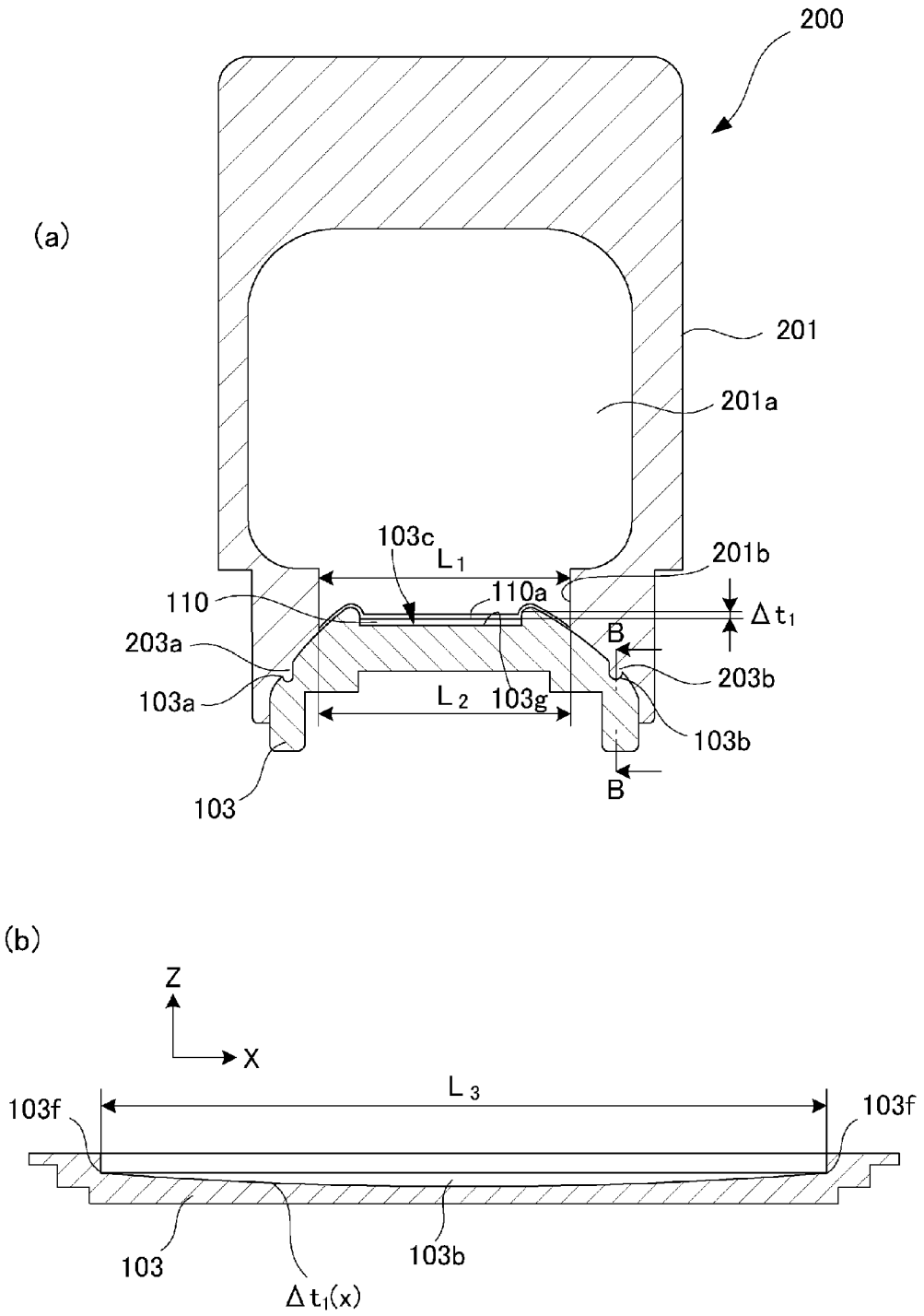
FIG. 10(*a*) is a sectional view of the grease container-applicator in the second embodiment of the present invention, and FIG. 10(*b*) is a sectional view of the film guide at a plane B-B in FIG. 10(*a*).

Next, referring to FIGS. 10(*a*) and 10(*b*), the second embodiment of the present invention is described. FIG. 10(*a*) is a sectional view of the grease container-applicator, etc., in this embodiment. FIG. 10(*b*) is a sectional view of the film guide 103 in this embodiment, at a plane B-B in FIG. 10(*a*).

In the case of the fixing device in the first embodiment, grease was uniformly applied to the ceramic heater 110 (and part of film guide 103), to a preset thickness. In comparison, the fixing device in this embodiment is structured so that the amount by which the lengthwise end portions of the ceramic heater 110 (and part of film guide 103) are coated with grease, per unit area, is greater than the amount by which the lengthwise center portion of the ceramic heater 110 (and part of film guide 103) is coated with grease, per unit area.

For example, in a case of a fixing device structured so that the lengthwise center portion of the nip (fixation nip) between the film guide 103 and pressure roller 106 is higher in internal pressure than the lengthwise end portions of the nip, the grease applied to the lengthwise center portion of the ceramic heater 110 is likely to move outward of the lengthwise center portion of the nip between the film guide 103 and pressure roller 106. As the grease moves outward of the lengthwise center portion of the nip, the layer of the grease applied to the ceramic heater 110 (and part of film guide 103) becomes nonuniform in thickness in terms of the lengthwise direction of the ceramic heater 110. This is problematic in that it possibly reduces the image forming apparatus 1 (fixing device 40) in image quality during the initial period of usage of the fixing device 40.

This problem can be solved by applying grease to the ceramic heater 110 (and part of film guide 103) in such a manner that the lengthwise end portions of the ceramic heater 110 becomes greater in the amount of grease, per unit area, than the lengthwise center portion of the ceramic heater 110. This embodiment is the same as the first embodiment, except that the grooves 103*a* and 103*b* of the film guide 103 in this embodiment are different in shape from the counterparts in the first embodiment. Thus, the components of the fixing device in this embodiment other than the grooves 103*a* and 103*b* are not described here.

That is, like the film guide 103 in the first embodiment, the film guide 103 in this embodiment has a groove 103*c*, the bottom surface 103*g* of which is flat, and in which the ceramic heater (pressing member) 110, which is long and narrow, is to be embedded. The groove 103*c* extends in the lengthwise direction of the film guide 103. The ceramic heater 110 is embedded in this groove 103*c* of the film guide 103. The grooves 103*a* and 103*b* are shaped so that their distance from the surface 110*a* (FIG. 10(*a*)) of the ceramic heater 110 (in the groove 103*c* of the film guide 103), which is facing the inward surface of the fixation film 101, and on which the fixation film 101 slides, is greater across their center portion than their lengthwise end portions in terms of their lengthwise direction.

In other words, the grooves 103*a* and 103*b* are shaped like a crown, as seen from the direction perpendicular to the lengthwise direction of the film guide 103. "Shaped like a crown" means that the external diameter of the lengthwise center portion is greater than the external diameter of the lengthwise end portions. The reason why the grooves 103*a* and 103*b* were said to be shaped like a crown is that in terms of the lengthwise direction of the grooves 103*a* (103*b*) in FIG. 10(*b*), they look as if the external diameter of the lengthwise center portion is greater in diameter than the external diameter of the lengthwise end portions.

The protrusive guides 203*a* and 203*b* of the grease container-applicator 200 are guided by the grooves 103*a* and 103*b* of the film guide 103, which are bent in a slight curvature in the form of an arc, as the grease container-applicator 200 is moved along the film guide 103. Therefore, the distance between the grease application surface (L2 in FIG. 10(*a*)) of the film guide 103 and the grease outlet 201*b*, in terms of the direction indicated by the arrow mark Z, gradually increases from the lengthwise center toward the lengthwise ends. Therefore, the gap Δt1 between the grease application surface of the ceramic heater 110 and grease outlet 201*b* gradually increases from the lengthwise center toward the lengthwise ends.

Also in the case of this embodiment, the lengthwise ends of each of the grooves 103*a* and 103*b* are provided with a regulating surface 103*f*, which determines in dimension, the range (L3 in FIG. 10(*b*)), in terms of the lengthwise direction of the film guide 103, across which the ceramic heater 110 (and part of film guide 103) is to be coated with the grease.

The film unit 111 is designed so that the curvature of each of the grooves 103*a* and 103*b* of the film guide 103 satisfies the following mathematical formula:

$$M_1 = \int_0^{L_3} \Delta t_1 dx \times L_2 \tag{1}$$

On the other hand, a structural arrangement for applying grease to the ceramic heater 110 in such a manner that the lengthwise center portion of the ceramic heater 110 becomes greater in the amount of grease than the lengthwise end portions, unlike the structural arrangement in the first embodiment, is described.

For example, in a case where the pressure between the lengthwise center portion of the film guide 103 and the lengthwise center portion of pressure roller 106 in terms of the their lengthwise direction is higher than that between the lengthwise end portions of the film guide 103 and corresponding portions of the film guide 103, the grease applied to the lengthwise center portion of the ceramic heater 110 is likely to migrate from the lengthwise center portion toward the lengthwise end portions. As the grease migrates from the lengthwise center portion toward the lengthwise end portions, the layer of the applied grease on the ceramic heater 110 (and part of film guide 103) becomes nonuniform in thickness, and therefore, it is possible that the image forming apparatus 1 (fixing device 40) will reduces in image quality as described previously regarding the first embodiment.

In the case of this structural arrangement, therefore, the problem can be solved by applying the grease in such a manner that the lengthwise center portion of the ceramic heater 110 becomes greater in the amount of the applied grease than the lengthwise end portions of the ceramic heater 110. In this case, the grooves 103*a* and 103*b* are to be gently bent in the curvature in the form of an arc, in the opposite direction from the above-described direction. This structural arrangement can make the amount by which the grease is applied to the lengthwise center portion of the ceramic heater 110, greater than the amount by which the grease is applied to the lengthwise end portions of the ceramic heater 110.

That is, in the case of this example of structural arrangement, the film guide 103 has the groove 103*c* which is flat at the bottom, and in which the ceramic heater 110 is to be embedded. Further, the groove 103*a* and 103*b* are shaped so that the distance from them to the surface 110*a* of the ceramic heater 110 (embedded in groove 103*c*), on which the fixation film 101 slides, is greater across the lengthwise end portions of the film guide 103 than the lengthwise center end portions.

As described above, this embodiment can provide the same effects as the first embodiment. Further, even if the pressure between the film guide 103 and pressure roller 106 is nonuniform in terms of the lengthwise direction of the film guide 103 (pressure roller 106), it is possible to prevent the ceramic heater 110 from becoming nonuniform in the amount of the grease, per unit area, in the lengthwise direction of ceramic heater. Therefore, this embodiment can solve the problem that the image forming apparatus 1 (fixing device 40) reduces in image quality during the initial period of usage of the fixing device 40.

Further, it is feasible to structure the film unit 111 so that instead of providing the film guide 103 with the grooves 103*a* and 103*b* and protrusive guides 203*a* and 203*b*, the portion of the grease storing member 201, which extend downward from the edges of the grease outlet 201*b*, accommodate the protrusive curvature of the film guide 103, so that the grease storing member 201 slides on the film guide 103 in the lengthwise direction of the film guide 103.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 036758/2013 filed Feb. 27, 2013, which is hereby incorporated by reference.

What is claimed is:

1. An image heating apparatus to which a lubricant application container is dismountably mountable, said image heating apparatus comprising:

an endless belt configured to heat, in a nip, a toner image on a sheet;

a rotatable member cooperative with said endless belt to form said nip;

an urging member extending in a widthwise direction of said endless belt and configured and positioned to urge said endless belt toward said rotatable member; and a guide portion configured and positioned to guide a sliding movement of the lubricant application container while substantially preventing dismounting of the lubricant application container during the sliding movement, wherein the lubricant application container is effective to apply a lubricant to a sliding surface of said urging member relative to said endless belt along a longitudinal direction of said urging member, in a state that endless belt is dismounted from said image heating apparatus.

2. An apparatus according to claim 1, wherein the distance from the sliding surface to said guide portion is larger in a central portion than at the opposite longitudinal end portions thereof.

3. An apparatus according to claim 1, wherein said guide portion includes a recess extending along the longitudinal direction thereof.

4. An apparatus according to claim 1, wherein said guide portion includes a projection extending along the longitudinal direction thereof.

5. An apparatus according to claim 1, further comprising a heater supported by said urging member and configured to heat said endless belt.

6. A lubricant application system including a lubricant application container and an image heating apparatus to which the lubricant application container is dismountably mountable, said lubricant application system comprising:

(i) said image heating apparatus comprising, (i-i) an endless belt configured to heat, in a nip, a toner image on a sheet, (i-ii) a rotatable member cooperative with said endless belt to form said nip, and (i-iii) an urging member extending in a widthwise direction of said endless belt and configured and positioned to urge said endless belt toward said rotatable member, and (i-iv) a guide portion configured and positioned to guide a sliding movement of the lubricant application container while substantially preventing dismounting of the lubricant application container during the sliding movement, wherein the lubricant application container is effective to apply a lubricant to a sliding surface of said urging member relative to said endless belt along a longitudinal direction of said urging member, in a state that endless belt is dismounted from said image heating apparatus; and (ii) said lubricant application container comprising, (ii-i) an accommodating portion configured to accommodate the lubricant, and (ii-ii) an engaging portion engageable with said guide portion.

7. A system according to claim 6, wherein the distance from the sliding surface to said guide portion is larger in a central portion than at the opposite longitudinal end portions thereof.

8. A system according to claim 6, wherein said lubricant application container is provided with a grip portion configured to be gripped during the sliding movement.

9. A system according to claim 6, wherein said guide portion includes a recess extending along the longitudinal direction, and said engaging portion includes a projection engageable with said recess.

10. A system according to claim 6, wherein said guide portion includes a projection extending along the longitudinal direction, and said engaging portion includes a recess engageable with said projection.

11. A system according to claim 6, further comprising a heater supported by said urging member and configured to heat said endless belt.

12. A lubricant application container for applying a lubricant to an urging member of an image heating apparatus, said image forming apparatus including an endless belt configured to heat, in a nip, a toner image on a sheet, a rotatable member cooperative with said endless belt to form said nip, and an urging member extending in a widthwise direction of said endless belt and configured and positioned to urge said endless belt toward said rotatable member, said lubricant application container comprising:

an accommodating portion configured to accommodate the lubricant;

a discharge opening configured and positioned to permit the lubricant to discharge from said accommodating portion; and an engaging portion engaged with the image heating apparatus and configured to be guided by the image heating apparatus and to substantially prevent dismounting of said lubricant application container from the image heating apparatus when said lubricant application container is slid relative to the image heating apparatus.

13. A lubricant application container according to claim 12, further comprising a cap closing said discharge opening.

14. A lubricant application container according to claim 12, further comprising a grip portion to be gripped during the sliding movement.

15. A lubricant application container according to claim 12, wherein said engaging portion includes a recess.

16. A lubricant application container according to claim 12, wherein said engaging portion includes a projection.

17. An endless belt exchanging method for an image heating apparatus, said image heating apparatus including an endless belt configured to heat, in a nip, a toner image on a sheet, a rotatable member cooperative with said endless belt to form said nip, and an urging member extending in a widthwise direction of said endless belt and configured and positioned to urge said endless belt toward said rotatable member, said endless belt exchanging method comprising the steps of:

dismounting said endless belt from said image heating apparatus;

engaging an engaging portion of a lubricant application container with said image heating apparatus to substantially prevent dismounting of the lubricant application container from said image hating apparatus;

applying the lubricant to said urging member while sliding said lubricant application container along a longitudinal direction of said urging member in a state that said lubricant application container is guided at said guiding portion by said image heating apparatus;

dismounting said lubricant application container from said image heating apparatus; and mounting a fresh endless belt to said image heating apparatus.

18. A lubricant application container dismountable mountable to the image heating apparatus recited in claim 1, comprising:

an accommodating portion configured to accommodate the lubricant;

a discharge opening configured and positioned to permit the lubricant to discharge from said accommodating portion; and an engaging portion configured to engage the guide portion of the image heating apparatus, said engaging portion comprising a projected portion provided at a position farther away from said discharge opening than said accommodating portion, said projected portion having a root portion which is thinner than a free end portion thereof.

19. A lubricant application container according to claim 18, further comprising a cap closing said discharge opening.

* * * * *